United States Patent [19]

McChesney et al.

[11] Patent Number: 4,466,412

[45] Date of Patent: Aug. 21, 1984

[54] PRIMING AND ACCELERATION FUEL ENRICHMENT SYSTEM FOR AN INTERNAL COMBUSTION ENGINE

[75] Inventors: Richard M. McChesney, Waukegan; Chester G. DuBois, Zion, both of Ill.

[73] Assignee: Outboard Marine Corporation, Waukegan, Ill.

[21] Appl. No.: 338,335

[22] Filed: Jan. 11, 1982

Related U.S. Application Data

[63] Continuation-in-part of Ser. No. 92,575, Nov. 8, 1979, Pat. No. 4,312,314.

[51] Int. Cl.[3] ..... F02M 1/16

[52] U.S. Cl. ..... 123/492; 123/187.5 R

[58] Field of Search ..... 123/187.5 R, 492, 438

[56] References Cited

U.S. PATENT DOCUMENTS

| | | | |
|---|---|---|---|
| 2,859,738 | 11/1958 | Campbell | 123/492 |
| 3,371,658 | 3/1968 | Turner | 123/187.5 R |
| 3,616,780 | 11/1971 | Helle | 123/492 |
| 3,623,459 | 11/1971 | Gordon | 123/492 |
| 3,983,850 | 10/1976 | Stumpp | 123/492 |
| 4,240,383 | 12/1980 | Horbelt | 123/492 |
| 4,266,522 | 5/1981 | Williams | 123/492 |
| 4,284,040 | 8/1981 | Baltz | 123/187.5 R |
| 4,286,553 | 9/1981 | Baltz | 123/187.5 R |
| 4,312,314 | 1/1982 | McChesney | 123/438 |

*Primary Examiner*—Ronald B. Cox

*Attorney, Agent, or Firm*—Michael, Best & Friedrich

[57] ABSTRACT

Disclosed herein is an engine operable between a low speed and a range of speeds above the low speed, which engine comprises a combustion chamber, a throttle operatively connected with the engine for movement between a low speed position for operating the engine at the low speed and a range of positions spaced from the low speed position for operating the engine within the range of speeds above the low speed, a fuel pump adapted to communicate with a fuel source, a first fuel delivery system communicating with the fuel pump and with the combustion chamber for supplying fuel to the combustion chamber subject to control by the throttle, and a second fuel delivery system communicating with the fuel source and with the combustion chamber independently of the first fuel delivery system, which second fuel delivery system includes a squeeze bulb adapted to communicate with the fuel source, a valve operable between open and closed positions to control fuel flow to the combustion chamber in response to operation of the pump and in response to squeezing of the squeeze bulb, a spring biasing the valve to the closed position, and a control for operating the valve including a manually operable member connected to the valve for opening the valve, and a linkage connected to the valve and to the throttle for operating the valve in response to advancement of the throttle from the low speed position to locate the valve in the open position so as to introduce fuel from the fuel pump into the combustion chamber for a predetermined time interval.

7 Claims, 7 Drawing Figures

Fig. 3
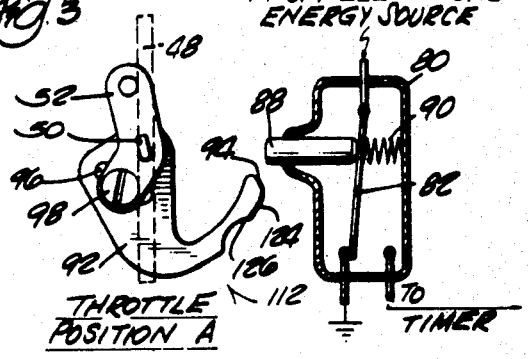
Fig. 4
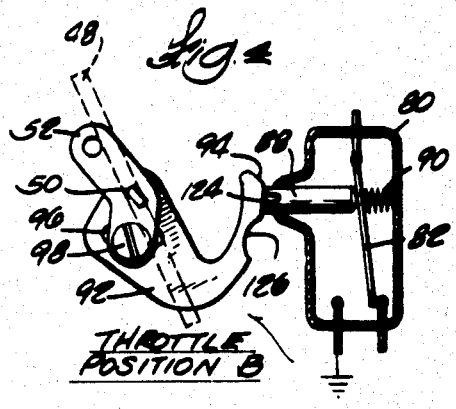
Fig. 5
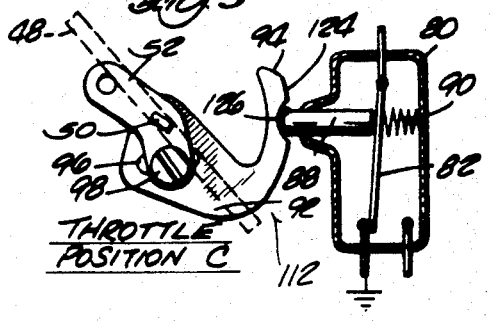
Fig. 6
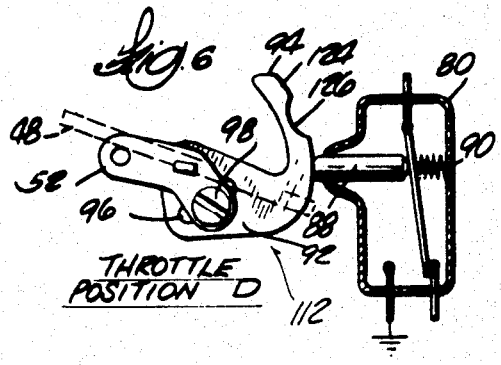
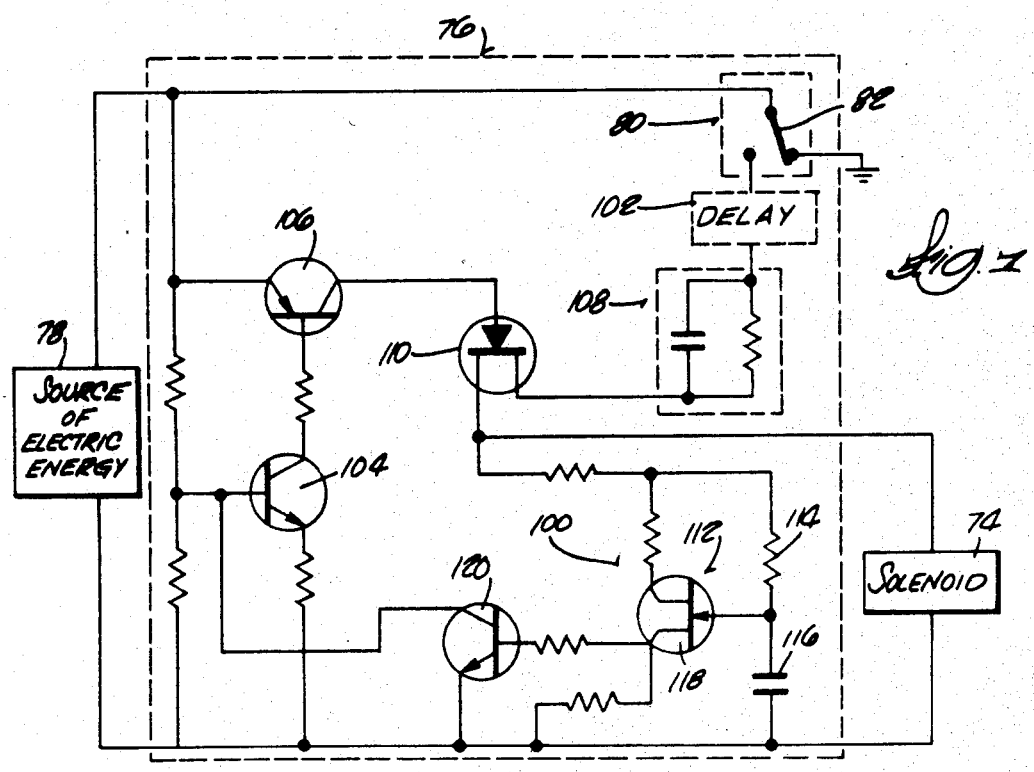
Fig. 7

PRIMING AND ACCELERATION FUEL ENRICHMENT SYSTEM FOR AN INTERNAL COMBUSTION ENGINE

RELATED APPLICATION

This application is a continuation-in-part of our earlier co-pending application Ser. No. 092,575 filed Nov. 8, 1979, now U.S. Pat. No. 4,312,314.

FIELD OF THE INVENTION

The invention generally relates to internal combustion engines and, more particularly, to priming and acceleration fuel enrichment systems for internal combustion engines.

DESCRIPTION OF THE PRIOR ART

Attention is directed to the following United States Patents:

| | | |
|---|---|---|
| Aono et al | 3,673,989 | July 4, 1972 |
| Sauer | 3,726,261 | April 10, 1973 |
| Pattas | 4,056,081 | November 1, 1977 |
| Hoshi et al | 4,119,061 | October 10, 1978 |

Attention is also directed to pending patent application Ser. No. 005,990, entitled "Electronic Accelerator Pump Timing Control". This pending application is assigned to the assignee of the present application.

SUMMARY OF THE IVNENTION

The invention provides an engine operable between a low speed and a range of speeds above the low speed, which engine comprises a combustion chamber, throttle means operatively connected with the engine for movement between a low speed position for operating the engine at the low speed and a range of positions spaced from the low speed position for operating the engine within the range of speeds above the low speed, a fuel pump adapted to communicate with a fuel source, a first fuel delivery means communicating with the fuel pump and with the combustion chamber for supplying fuel to the combustion chamber subject to control by the throttle means, and a second fuel delivery means communicating with a fuel source and with the combustion chamber independently of the first fuel delivery means, which second fuel delivery means includes a squeeze bulb adapted to communicate with the fuel source, valve means operable between open and closed positions to control fuel flow to the combustion chamber in response to operation of the pump and in response to squeezing of the squeeze bulb, means biasing the valve means to the closed position, and means for controlling operation of the valve means including manually operable means connected to the valve means for opening the valve means, and means connected to the valve means and to the throttle means for operating the valve means in response to advancement of the throttle means from the low speed position to locate the valve means in the open position so as to introduce fuel from the fuel pump into the combustion chamber for a predetermined time interval.

In one embodiment of the invention, the mannually operable means comprises a solenoid operable to overcome the means biasing the valve means, and an electrical switch connected to the solenoid and operable to supply current thereto so as to overcome the means biasing the valve means.

In one embodiment of the invention, the manually operable means comprises a manually operable lever operable to overcome the means biasing the valve means.

In one embodiment of the invention, the means for operating the valve means includes first delay means for preventing a second opening of the valve means in response to a second advancement of the throttle means from the low speed position until after the expiration of the predetermined time interval.

The invention also provides an engine operable between a low speed and a range of speeds above the low speed, which engine comprises a combustion chamber, throttle means operatively connected with the engine for movement between a low speed position for operating the engine at the low speed and a range of positions spaced from the low speed position for operating the engine within the range of speeds above the low speed, and fuel delivery means communicating with the combustion chamber and adapted for connection with a fuel source, which fuel delivery means is operative for introducing fuel from the fuel source into the combustion chamber and including a fuel pump for pumping fuel through the fuel delivery means, a squeeze bulb for pumping fluid through the fuel delivery means, and means mechanically connected with the throttle means for controlling fuel flow into the combustion chamber including a normally closed valve means movable in the fuel delivery means between a closed position blocking the introduction of fuel through the fuel delivery means into the combustion chamber by the fuel pump and the squeeze bulb not withstanding operation of the fuel pump and squeezing of the squeeze bulb and an open position permitting the introduction of fuel through the fuel delivery means into the combustion chamber during operation of the fuel pump or in response to squeezing of the squeeze bulb, and actuating means for moving the valve means from the closed position to the open position in response to squeezing of the squeeze bulb and in response to advancement of the throttle means from the low speed position and for maintaining the valve means in the open position for a predetermined time interval after advancement of the throttle means from the low speed position to thereby permit the introduction of fuel through the fuel delivery means into the combustion chamber.

Other features and advantages of embodiments of the invention will become apparent upon review of the following general description, the drawings, and the appended claims.

DESCRIPTION OF THE DRAWINGS

FIG. 3 is an enlarged, partial view of an alternative embodiment of the acceleration fuel enrichment and priming system which may be incorporated in FIG. 1 and in which the engine throttle is shown in its low speed position;

FIG. 4 is a view of the acceleration fuel enrichment and priming system shown in FIG. 3 and in which the engine throttle is shown in a position slightly advanced from its low speed position;

FIG. 5 is a view of the acceleration fuel enrichment and priming system shown in FIG. 3 and in which the engine throttle is shown in a second position within the range of positions between the low speed and high speeds of the throttle;

FIG. 6 is a view of the acceleration fuel enrichment and priming system shown in FIG. 3 and in which the engine throttle is shown in a position advanced of the second position; and FIG. 7 is a schematic view of an electronic control circuit incorporated in the engine shown in FIG. 1.

Figure 1:
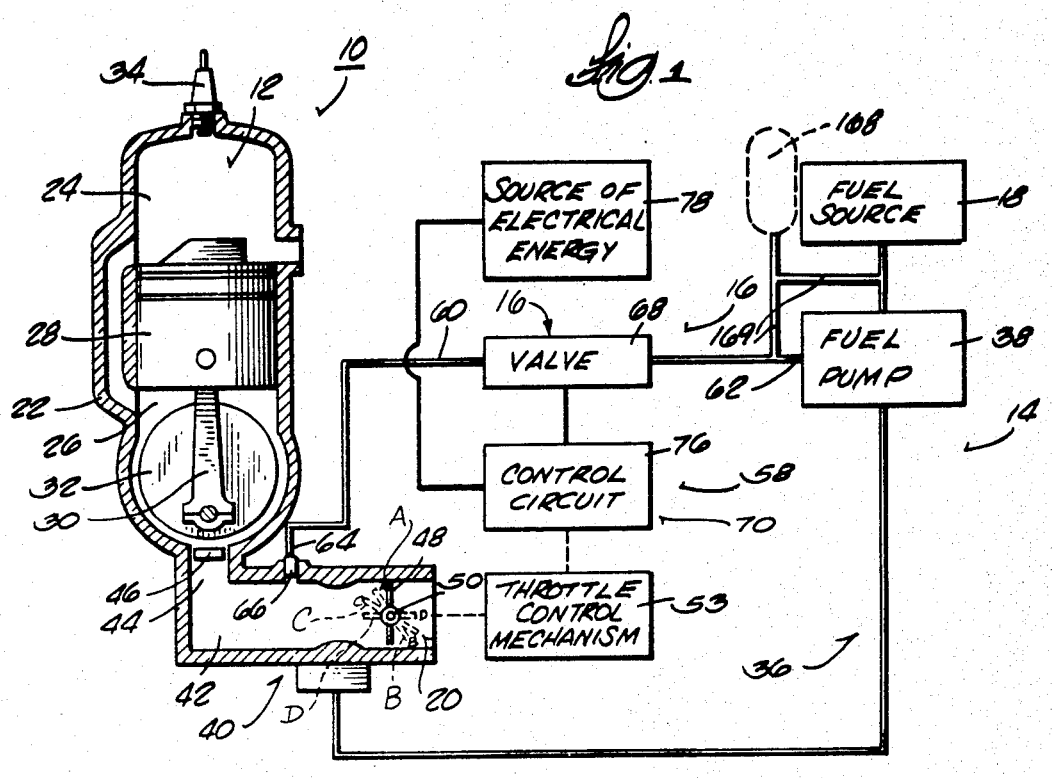
FIG. 1 is a diagrammatic view of an internal combustion engine having an associated acceleration fuel enrichment and priming system.

Before explaiing the embodiments of the invention in detail, it is to be understood that the invention is not limited in its application to the details of construction and the arrangement of components set forth in the following description or illustrated in the drawing. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is an internal combustion engine 10 which generally includes a combustion chamber 12 and associated first and second fuel delivery means, respectively 14 and 16, which introduce fuel from a fuel source 18 into the combustion chamber 12 to sustain engine operation. The engine 10 also includes throttle means 20 for controlling engine operation between a low or idle speed and a range of speeds above the low speed, up to and including a high or full power speed.

While various engine cnstructions are possible, in the illustrated embodiment, a block member 22 includes a cylinder 24 which defines the combustion chamber 12. The block member 22 also includes a crankcase 26 which extends from the cylinder 24. A piston 28 is mounted for reciprocative movement inside the cylinder 24, and is connected by a connecting rod 30 to a crank shaft 32 which is rotatably mounted on the crankcase 26. A spark plug 34 or the like extends into the combustion chamber 12. Fuel which is introduced into the combustion chamber 12 by the first and second fuel delivery means 14 and 16 is ignited by the spark plug 34, thereby causing reciprocative movement of the piston 28 which in turn drives the crankshaft 32.

The first fuel delivery means 14 represents the primary fuel supply system for the engine 10 and includes fuel conduit means 36 which conducts fuel from the source 18 into the combustion chamber 12. Fuel pumping means in the form of an electrical fuel pump 38 or the like communicates with the fuel conduit means 36 for pumping fuel therethrough.

While various constructions are possible, in the illustrated embodiment, the fuel conduit means 36 includes a carburetor 40 having an air induction passage 42 and an air-fuel induction port 44 communicating with the crankcase 26, typically through a conventional reed valve assembly 46.

In this construction, air is drawn from the atmosphere through the air induction passage 42 in response to pulsating pressure variations which occur in the crankcase 26 and which are occasioned by piston reciprocation. At the same time, fuel is drawn by suction from the carburetor 40 into the air stream. The resulting air-fuel mixture is ultimately drawn through the reed valve assembly 46 and into the combustion chamber 12 for ignition.

Figure 2:
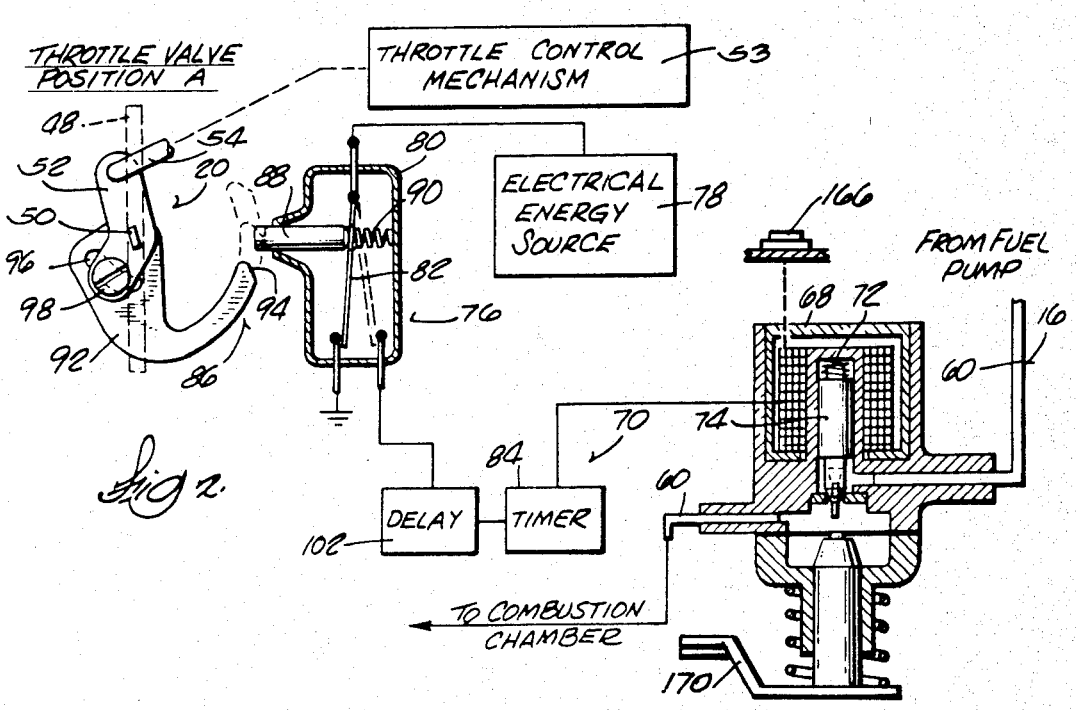
FIG. 2 is an enlarged and diagrammatic view of the priming and acceleration fuel delivery system incorporated in the engine shown in FIG. 1.

In this arrangement, the throttle means 20 controls the volume of air which is drawn through the air induction passage 42, and, in doing so, provides the air-fuel mixture. The speed of the engine 10 is thus controlled. While various constructions are possible, in the illustrated embodiment, the throttle means 20 includes a throttle or butterfly valve 48 which is mounted on a shaft 50 in the air induction passage 42. As is best shown in FIG. 2, a lever arm 52 or the like is carried by the shaft 50 and is linked, such as by a throttle cable 54, to a suitable throttle control mechanism 53 accessible to the operator. For example, the throttle control mechanism 53 could take the form of an accelerator pedal or lever.

By virtue of this arrangement, operation of the throttle control mechanism 53 by the operator rotates the shaft 50 and moves the throttle valve 48 in the air induction passage 42 between two rotationally spaced positions. In one position (shown in solid lines as Position A in FIG. 1), the throttle valve 48 substantially blocks the flow of air through the air induction passage 42, and only enough air to support engine operation at the low or idle speed is permitted. For this reason, Position A will hereafter be identified as the low speed position of the throttle valve 48.

When the throttle valve 48 is located in its second rotational position (shown in phantom lines as Position D in FIG. 1), the throttle valve 48 offers susbstantially no resistance to the flow of air through the air induction passage 42. The substantial volume of air needed to sustain engine operation at the high speed is thus permitted to flow through the air induction passage 42. For this reason, Position D will hereafter be identified as the high speed position of the throttle valve 48.

A range of positions of the throttle valve 48 is located between the low and high speed positions just described, each finite position within the range controlling the operation of the engine 10 at a different speed between the low and high speed. For the purpose of description, two such positions within the range of positions are shown and identified in phantom lines in FIG. 1 as Positions B and C.

The second fuel delivery means 16 represents an enrichment fuel supply system for the engine 10, which means is selectively operative in response to advancement of the throttle valve 48 from its low speed position (or Position A in FIG. 1) to deliver fuel to the combustion chamber 12 in addition to the fuel being delivered by the first fuel delivery means 14. As will be described in greater detail later herein, the operation of the second fuel delivery means 16 is controlled by suitable means 58 (see FIG. 1) such that the flow of enrichment fuel through the second fuel delivery means 16 occurs for only a predetermined time interval after advancement of the throttle valve 48 from its low speed position. After this predetermined time interval elapses, the control means 58 terminates the flow of fuel through the second fuel delivery means 16.

While various constructions are possible, in the illustrated embodiment (see FIG. 1), the second fuel delivery means 16 includes a fuel supply conduit 60 having an inlet end 62 communicating with the fuel pump 38 and an outlet end 64 communicating with the air induction passage 42 downstream of the throttle valve 48. In the illustrated embodiment, a fuel nipple 66 or the like communicates with the outlet end 64 of the fuel supply conduit 60 to control the volume of fuel ultimately introduced into the air induction passage 42 through the fuel supply conduit 60 during operation of the fuel pump 38.

In this construction, the control means 58 includes a valve assembly 68 connected in line with the fuel supply conduit 60 between the fuel pump 38 and the nipple 66. The valve assembly 68 is movable between a closed position (shown in solid lines in FIG. 2) and an open position (shown in phantom lines in FIG. 2). When in its closed position, the valve assembly 68 blocks the flow of fuel through the fuel supply conduit 60, notwithstanding operation of the fuel pump 38. When in its open position, the valve assembly 68 permits the flow of fuel through the fuel supply conduit 60 during the operation of the fuel pump 38.

The control means 58 also includes actuating means 70 which links operation of the valve assembly 68 with operation of the throttle means 20. As will be described in greater detail later herein, the actuating means 70 is operative to move the valve assembly 68 from its closed to its open position in response to advancement of the throttle valve 48 from its low speed position. Additionally, the actuating means 70 is operative to maintain the valve assembly 68 in its open position for the predetermined time interval after advancement of the throttle valve 48. After expiration of the predetermined time interval, the valve assembly 68 is returned by the actuating means 70 to its closed position.

While various constructions are possible, in the illustrated embodiment, the actuating means 70 includes a spring 72 which biases the valve assembly 68 toward its closed position, together with a solenoid 74 which is operatively connected with the valve assembly 68 and, when electrically energized, moves the valve assembly 68 from its closed position to its open position against the action of the biasing spring 72.

The actuating means 70 also includes an electrical control circuit 76 which is connected to a source of electrical energy 78, such as a DC battery, and controls the flow of electrical energy from the battery to the solenoid 74.

More particularly, and referring first principally to FIG. 2, the control circuit 76 includes switching means which, in the illustrated embodiment, takes the form of a conventional switch assembly 80. The switch assembly 80 has a switch arm 82 which is operatively movable between an off position (shown in solid lines in FIG. 2) to block the flow of electrical energy through the switch assembly 80 and an on position (shown in phantom lines in FIG. 2) to permit the flow of electrical energy through the switch assembly 80.

Still referring principally to FIG. 2, the control circuit 76 also includes timer means 84 interposed in the circuit 76 between the switch assembly 80 and the solenoid 74. As will be described in greater detail later herein, the timer means 84 is actuated by movement of the switch arm 82 from its off position to its on position to permit the flow of electrical energy to the solenoid 74 for the predetermined time interval. After the predetermined time interval elapses, the timer means 84 interrupts the flow of electrical energy to the solenoid 74.

The actuating means 70 further includes linkage means 86 which operatively connects the switch assembly 80 with the throttle means 20 to move the switch arm 82 between its off position and its on position in response to advancement of the throttle valve 48. While various constructions are possible, in the illustrated embodiment, the linkage means 86 takes the form of a cam and pin follower assembly which transforms advancement of the throttle valve 48 from its low speed position (or Position A in FIG. 1) into movement of the switch arm 82 from its off position to its on position.

As shown in FIG. 2, the cam and pin follower assembly 86 includes a pin 88 which is operatively connected with the switch arm 82 and movable between a normal position (shown in solid lines in FIG. 2) and a displaced position (shown in phantom lines in FIG. 2) to thereby move the switch arm 82 between its off and on positions. While various constructions are possible, in the illustrated embodiment, the switch arm 82 is biased, such as by a spring 90, toward its off position, thereby also biasing the pin 88 toward its normal position. In this arrangement, the switch arm 82 is moved from its off position to its on position against the action of the biasing spring 90 in response to movement of the pin 88 from its normal position to its displaced position.

The cam and pin follower mechanism 86 also includes a cam plate 92 which is carried by the throttle shaft 50 and is bolted or otherwise suitably attached to the throttle lever arm 52. By virtue of this construction, movement of the throttle lever arm 52 in response to operation of the throttle control mechanism 53 simultaneously moves the throttle valve 48 and the cam plate 92.

When the throttle valve 48 is in its low speed position (shown as Position A in FIGS. 1 and 2), the cam plate 92 is positioned on the lever arm 52 so that the leading edge 94 of the cam plate 92 is located in a disengaged position relative to the pin 88. The switch arm 82 is thus disposed by the spring 90 in its normally biased off position. The pin 88 is likewise disposed in its normal position.

As shown in phantom lines in FIG. 2, advancement of the throttle valve 48 from its low speed position moves the leading edge 94 of the cam plate 92 into engagement with the pin 88. The pin 88 is thereby moved into its displaced position, concurrently moving the switch arm 82 into its on position. With the switch arm 82 thus positioned, current flows through the switch assembly 80, and the timer means 84 is actuated to energize the solenoid 74 for the predetermined time interval.

In the illustrated embodiment (see FIG. 2), the position of the cam plate 92 on the throttle lever arm 52 may be adjusted to vary the particular point at which advancement of the throttle valve 48 beyond its low speed position actuates the timer means 84. More particularly, in this embodiment, the cam plate 92 is rotatable relative to the shaft 50 and includes an elongated slot 96. An adjusting screw 98 or the like passes through the slot 96 to secure the cam plate 92 on the lever arm 52. By loosening the adjusting screw 98 when the throttle valve 48 is in its low speed position, the cam plate 92 may be rotated relative to the shaft 50 within the limits defined by the slot 96, thereby adjusting the position of the leading edge 94 of the cam plate 92 relative to the pin 88. Such adjustment of the cam plate 92 in effect advances or retards the degree of throttle valve movement beyond the low speed position necessary to operate the switch assembly 80 and thereby actuate the timer means 84.

Reference is now made to FIG. 7 and the particular control circuit 76 associated with the above described linkage assembly 86. While various configurations are possible, in the illustrated embodiment, the control circuit 76 generally includes associated first delay means 100. More particularly, after the throttle valve 48 has been advanced from is low speed position to activate the timer mans 84, the first delay means 100 prevents subsequent actuation of the timer means 84 in response to a subsequent throttle valve advancement until after the predetermined time interval has elapsed. By virtue of this operation, once the timer means 84 is actuated, any further movement of the throttle valve 48 during the following predetermined time interval is ineffective for reactuating the timer means 84 to prolong or otherwise alter the length of the time interval and thereby to affect the quantity of enrichment fuel delivered.

The control circuit 76 may also include second delay means 102 in addition to the just described first delay means 100. The second delay means 102 prevents subsequent actuation of the timer means 84 in response to a subsequent advancement of the throttle valve 48 from its low speed position until after the throttle valve 48 has been retained in its low speed position for a preselected period of time, regardless of the expiration of the predetermined time interval of the timer means 84. Uninterrupted actuation of the timer means 84 during frequent advancement or "pumping" of the throttle valve 48 from its low speed position is thereby prevented.

While a circuit having the above generally described delay means 100 and 102 may be variously constructed, in the illustrated embodiment, an electronic timing circuit similar to the one disclosed in application Ser. No. 005,990 (Peter Dogadko and Richard F. Jereb, Electronic Accelerator Pump Timing Control) is shown.

When illustrated control circuit 76 is connected to the electrical energy source 78, transistor 104 is turned on and operates in a saturated condition, allowing emitter-base current to flow in transistor 106. By this action, the circuit 76 is placed in a stand-by mode.

Once the control circuit 76 is in this stand-by mode, subsequent movement of the switch arm 82 from its off position to its on position in response to throttle valve advancement permits electrical energy to flow to a pulse-forming RC network 108. The RC network 108 applies a narrow positive trigger pulse to the gate of thyristor 110. The thyristor 110 turns on in response to this trigger pulse, and electrical energy flows through the emitter-collector circuit of transistor 106 and the thyristor 110 to energize the solenoid 74. The fuel valve assembly 68 is thus moved from its normally closed position to its open position, and fuel flow commences through the fuel supply conduit 60 in response to fuel pump operation.

When the thyristor 110 turns on, electrical energy also simultaneously flows through a relaxation oscillator 12. The relaxation oscillator 112 controls the interval of time during which the solenoid 74 is energized. The particular length of the time interval is predetermined by the values of resistor 114 and capacitor 116 in the relaxation oscillator 112.

More particularly, it takes a predetermined time interval for the voltage across capacitor 116 to build and reach the peak-point voltage of the associated unijunction transistor 118. When the peak-point voltage is reached, the unijunction transistor 118 turns on, and capacitor 116 discharges through the transistor 118. The discharge of the capacitor 116 through the transistor 118 is known as a "stop pulse" which monentarily turns on transistor 120 to shunt or ground the base of transistor 104. This, in turn, momentarily turns off transistor 104 and cuts off the base current supply to transistor 106. As a result, transistor 106 turns off.

When transistor 106 turns off, the flow of electrical energy to thyristor 110 is interrupted, turning thyristor 110 off. The solenoid 74 is consequently de-energized, and the spring 72 returns the fuel valve assembly 68 to its closed position. Fuel flow through the supply conduit 60 is thus interrupted. At this point, the circuit 76 is again in its stand-by mode, awaiting the next closure of the switch assembly 80 in response to throttle valve advancement to again energize the solenoid 74 for the predetermined time interval.

In the above circuit 76, once the switch arm 82 is moved from its off to its on position in response to advancement of the throttle valve 48 from its low speed position, the flow of electrical energy through the thyristor 110 simultaneously energizes the solenoid 74 and actuates the relaxation oscillator 112. During the subsequent predetermined time interval before capacitor 116 discharges, the circuit 76 ignores any intervening movement of the switch arm 82 to and from its closed position. Thus, movement of the throttle valve 48 back to its low speed position followed by subsequent advancement from its low speed position during the course of the predetermined interval will not prolong or otherwise alter the timed cycle of the relaxation oscillator 112. This circuitry corresponds to the heretofore described first delay means 100.

Referring now to the particular embodiment of the illustrated second delay means 102, and realizing that the second delay means 102 may be variously constructed, a conventional time-delay starting relay or the like is interposed in the circuit 76 between the switch assembly 80 and the RC pulse forming network 108. The time-delay starting relay prevents actuation of the RC pulse forming network in response to movement of the switch arm 82 to its on position until after the switch arm 82 has been retained in its off position for a preselected period of time. This, of course, requires that the throttle valve 48 be retained in its low speed position for this time period. Thus, frequent advancement of the throttle valve 48 to and from its low speed position will not repeatedly energize the solenoid 74 to provide enrichment fuel.

While the time intervals associated with the above circuit 76 may be varied to meet the particular operational demands of the engine 10, in one embodiment, the predetermined time interval of the timer means 84 is approximately 1 second, and the preselected time delay interposed by the time-delay starting relay 102 is approximately 2 seconds.

The second fuel delivery means also permits manual priming of the engine through the conduit 60 and valve 68. More particularly, as heretofore described, the fuel pump 38 and the valve 68 are electrically actuated, typically by means of a battery (not shown). In order that the engine may be manually primed should electrical failure occur, a manually actuated fuel pump, such as a resilient "squeeze" bulb 168 or the like (shown in phantom lines in FIG. 1), may be connected with a conduit 169 extending between the fuel source 18 and a point in the conduit 60 upstream of the valve 68. Alternatively, the squeeze bulb 168 can communicate solely with the conduit communicating between the fuel source and the fuel pump 38. Squeezing of the bulb 168 would force fuel through the pump 38. In addition, a manually actuated lever assembly 170 may be operatively connected with the valve 68 so that the valve 68 may be manually opened against the action of the biasing spring 72. The squeeze bulb 168 and lever assembly 170 provide a secondary or back-up primer system should electrical failure occur.

Alternatively, in order to selectively move the valve 68 between the closed and open positions, in the embodiment illustrated in FIG. 2, the valve can also be operated by means of a conventional switch 166 which is accessible for operation by the engine operator. Thus, after squeezing of the bulb 168, the operator may thereafter actuate the switch 166 to operate the second fuel delivery means 16 to prime the engine 10.

An alternative embodiment is shown in FIGS. 3 through 6. Components which are common to the heretofore described embodiment are assigned common reference numerals. Like the first described embodiment, the cam plate 92 is attached to the throttle lever arm 52 to engage the pin 88 and move the switch arm 82 from its off position to its on position in response to advancement of the throttle valve 48 from its low speed position. This particular sequence of operation is shown in FIGS. 3 and 4.

Also, like the first embodiment, movement of the switch arm 82 from its off position to its on position actuates the timer means 84 which energizes the solenoid 74 for a predetermined time interval to permit the flow of enrichment fuel through the fuel supply conduit 60.

However, unlike the first described embodiment, means 112 is provided for providing an additional time controlled emission of enrichment fuel to the engine 10 in response to movement of the throttle valve 48 to and from a preselected second position within the range of positions between its low and high speed positions. The second position is identified in phantom lines in FIG. 1 as Position C.

While various constructions are possible, in the embodiment illustrated in FIGS. 3 through 6, the outer peripheral edge 124 of the cam plate 92 includes a notched portion 126. The notched portion 126 is located so that, when the throttle valve 48 is disposed in its second position (phantom line Position C in FIG. 1 and as shown in FIG. 5), the pin 88 is located in the notch 126. As can be seen in FIG. 5, when the pin 88 is located in the notch 126, the action of the biasing spring 90 maintains the pin 88 in its normal position and the switch arm 82 is in its off position.

As can be seen in FIGS. 4 through 6, movement of the throttle valve 48 to and from the second position causes the pin 88 to slide successively into and out of the notched portion 126. The switch arm 82 is thereby successively moved from its off position to its on position, and the solenoid 74 is consequently energized for the predetermined time interval.

As in the first described embodiment, the control circuit 76 associated with the second embodiment may include the heretofore described first and second delay means 100 and 102. Thus, by virtue of the first delay means 100, advancement of the throttle valve 48 from its low speed position (solid line position A in FIG. 1 and as shown in FIG. 3) to a position in advance of the second position (for example, phantom line position D in FIG. 1 and as shown in FIG. 6) during a period of time less than the predetermined time interval will result in only a single actuation of the control circuit 76. By virtue of the second delay means 102, movement of the throttle valve 48 to and from its second position will not result in actuation of the control circuit 76, unless the throttle valve 48 is retained in its second position (phantom line Position C in FIG. 1 and as shown in FIG. 5) for the preselected time period determined by the second delay means 102.

As should now be apparent, the second fuel delivery means 16 serves as an acceleration fuel enrichment system and can be used as a fuel priming system for the engine 10. During periods of engine acceleration occasioned by advancement of the throttle valve 18, the second fuel delivery means 16 momentarily enriches the quantity of combustible fuel delivered to the combustion chamber 12. Such enrichment results in smooth and prompt engine response to instantaneous demands to accelerate. Likewise, during initial cranking operations, advancement of the throttle valve 48 will activate the second fuel delivery means 16 to deliver a time-measured amount of priming fuel to facilitate initial engine startup.

Various of the features of the invention are set forth in the following claims.

I claim:

1. An engine operable between a low speed and a range of speeds above the low speed, said engine comprising a combustion chamber, throttle means operatively connected with said engine for movement between a low speed position for operating said engine at the low speed and a range of positions spaced from said low speed position for operating said engine within the range of speeds above the low speed, a fuel pump adapted to communicate with a fuel source, a first fuel delivery means communicating with said fuel pump and with said combustion chamber for supplying fuel to said combustion chamber subject to control by said throttle means, and a second fuel delivery means communicating with a fuel source and with said combustion chamber independently of said first fuel delivery means, said second fuel delivery means including a squeeze bulb adapted to communicate with the fuel source, valve means operable between open and closed positions to control fuel flow to said combustion chamber in response to operation of said pump in response to squeezing of said squeeze bulb, means biasing said valve means to the closed position, and means for controlling operation of said valve means including manually operable means connected to said valve means for opening said valve means, and electrical circuit means connected to said valve means and to said throttle means for operating said valve means in response to advancement of said throttle means from said low speed position to locate said valve means in the open position so as to introduce fuel from said fuel pump into said combustion chamber for a predetermined time interval, said electrical circuit means including first delay means for preventing a second opening of said valve means in response to a second advancement of said throttle means from said low speed position until after expiration of said predetermined time interval and further including second delay means for preventing a second opening of said valve means in response to a second advancement of said throttle means from said low speed position until after said throttle means has been retained in said low speed position for a predetermined time period, regardless of the expiration of said predetermined time interval.

2. An engine operable between a low speed and a range of speeds above the low speed, said engine comprising a combustion chamber, throttle means operatively connected with said engine for movement between a low speed position for operating said engine at the low speed and a range of positions spaced from the low speed position for operating said engine within the range of speeds above the low speed, and fuel delivery means communicating with said combustion chamber and adapted for connection with a fuel source, said fuel delivery means being operative for introducing fuel from the fuel source into said combustion chamber and including a fuel pump for pumping fuel through said fuel delivery means, a squeeze bulb for pumping fluid through said fuel delivery means, and means mechanically connected with said throttle means for controlling fuel flow into said combustion chamber and including a normally closed valve means movable in said fuel delivery means between a closed position blocking the introduction of fuel through said fuel delivery means into said combustion chamber by said fuel pump and said squeeze bulb not withstanding operation of said fuel pump and squeezing of said squeeze bulb and an open position permitting the introduction of fuel through said fuel delivery means into said combustion chamber during operation of said fuel pump or in response to squeezing of said squeeze bulb, and electrical circuit actuating means for moving said valve means from said closed position to said open position in response to advancement of said throttle means from said low speed position, for maintaining said valve means in said open position for a predetermined time interval after advancement of said throttle means from said low speed position to thereby permit the introduction of fuel through said fuel delivery means into said combustion chamber, for preventing a second opening of said valve means in response to second advancement of said throttle means from said low speed position until after expiration of said predetermined time interval, and for preventing a second opening of said valve means in response to a second advancement of said throttle means from said low speed position until after said throttle means has been retained in said low speed position for a predetermined time period, regardless of the expiration of said predetermined time interval.

3. An engine in accordance with claim 1 wherein said manually operable means comprises a solenoid operable to overcome said means biasing said valve means, and an electrical switch connected to said solenoid and operable to supply current thereto so as to overcome said means biasing said valve means.

4. An engine in accordance with claim 1 wherein said manually operable means comprises a manually operable lever operable to overcome said means biasing said valve means.

5. An engine according to claim 2 wherein said electrical circuit actuating means includes means for biasing said valve means toward said closed position, solenoid means operatively connected with said valve means and energized in response to electrical energy for moving said valve means against the action of said biasing means from said closed position to said open position, circuit means electrically connected with said solenoid means and adapted for connection with a source of electrical energy, said circuit means being operative for conducting electrical energy from the electrical energy source to said solenoid means and including switching means operatively movable between an off position to prevent the conduction of electrical energy from the electrical energy source to said solenoid means through said circuit means and an on position to permit the conduction of electrical energy from the electrical energy source to said solenoid means through said circuit means, and timer means interposed in said circuit means intermediate said switching means and said solenoid means for energizing said solenoid means for a predetermined timed cycle after said switching means has been moved from said off position to said on position, said predetermined timed cycle corresponding to said predetermined time interval, and linkage means operatively connecting said switching means with said throttle means for moving said switching means between said off position and said on position in response to advancement of said throttle means from said low speed position.

6. An engine according to claim 5 wherein said linkage means includes pin means operatively connected with said switching means and movable between a normal position and a displaced position, said pin means being operative for moving said switching means between said off position and said on position in response to movement of said pin means between said normal position and said displaced position, and cam means operatively connecting said throttle means with said pin means for moving said pin means from said normal position to said displaced position in response to advancement of said throttle means from said low speed position.

7. An engine according to claim 6 and wherein said cam means includes a cam plate operatively connected with said throttle means for movement in response to throttle means movement, said cam plate having an outer peripheral surface located in a disengaged position relative to said pin means when said throttle means is in said low speed position and being moved into an engaged position with said pin means in response to advancement of said throttle means from said low speed position, and wherein said pin means includes means for biasing said pin means toward said normal position when said outer peripheral surface of said cam plate is in said disengaged position relative to said pin means while permitting movement of said pin means from said normal position to said displaced position in response to movement of said outer peripheral surface of said cam plate from said disengaged position into said engaged position with said pin means.

* * * * *